US009358746B1

(12) United States Patent
Pellegrini et al.

(10) Patent No.: US 9,358,746 B1
(45) Date of Patent: Jun. 7, 2016

(54) COLLECTION AND PROCESSING CONTAINER CONFIGURED FOR REMOVABLE DISPOSITION WITHIN A REFUSE COLLECTION VEHICLE

(71) Applicant: Sustainable Alternative Feed Enterprises, Reno, NV (US)

(72) Inventors: Louis Anthony Pellegrini, Los Altos, CA (US); John Pastusek, Arlington, TX (US)

(73) Assignee: Sustainable Alternative Feed Enterprises, Reno, NV (US)

( * ) Notice: Subject to any disclaimer, the term of this patent is extended or adjusted under 35 U.S.C. 154(b) by 706 days.

(21) Appl. No.: 13/835,814

(22) Filed: Mar. 15, 2013

(51) Int. Cl.

| | |
|---|---|
| ***B30B 1/12*** | (2006.01) |
| ***B30B 1/14*** | (2006.01) |
| ***B65F 3/14*** | (2006.01) |
| ***B65F 3/22*** | (2006.01) |
| ***B65F 3/24*** | (2006.01) |
| ***B30B 3/00*** | (2006.01) |
| ***B30B 9/12*** | (2006.01) |
| ***B30B 9/14*** | (2006.01) |
| ***B65F 1/14*** | (2006.01) |

(52) U.S. Cl.
CPC ... *B30B 3/00* (2013.01); *B30B 9/12* (2013.01); *B30B 9/14* (2013.01); *B65F 1/1623* (2013.01); *B65F 3/14* (2013.01); *B65F 3/22* (2013.01); *B65F 3/24* (2013.01)

(58) Field of Classification Search
CPC ..... B65F 3/14; B65F 3/143; B65F 3/22; B65F 3/28; B65F 3/20; B65F 3/201; B65F 3/24; B65F 1/16; B65F 1/1615; B65F 1/1623; B30B 9/12; B30B 9/121; B30B 9/14; B30B 9/04; B30B 9/02; B30B 9/06
See application file for complete search history.

(56) References Cited

U.S. PATENT DOCUMENTS

| | | | | | |
|---|---|---|---|---|---|
| 1,882,117 | A | * | 10/1932 | Butticci | B30B 9/12 100/100 |
| 2,130,099 | A | * | 9/1938 | Peterson | B65F 3/22 414/518 |
| 2,704,161 | A | * | 3/1955 | Ogden | B65F 3/22 198/300 |
| 4,034,880 | A | * | 7/1977 | Frenette | B60P 1/38 298/1 B |
| 4,727,804 | A | * | 3/1988 | Tondo | B30B 9/30 100/215 |

FOREIGN PATENT DOCUMENTS

| | | | | | |
|---|---|---|---|---|---|
| GB | 190907671 | A | * | 0/1910 | B65F 3/22 |

* cited by examiner

*Primary Examiner* — Jimmy T Nguyen
(74) *Attorney, Agent, or Firm* — Gard & Kaslow LLP

(57) ABSTRACT

A container for the working and transportation of food product waste is disclosed. The container includes a shell configured for removable disposition within a refuse collection vehicle. The shell includes an opening for receiving product, and a cover for sealing the opening except when open to permit product to be added to container. The cover may be operably connected to a lift and invert mechanism on the refuse collection vehicle for coordinated operation. A separation floor is disposed within the container to facilitate separation of liquid and solid constituents within the container. A working and transfer mechanism is disposed within the container to work food product waste prior to delivery of same to a processing facility, and to facilitate removal of the worked food product waste from the container through an output port of the container as part of the delivery of same.

19 Claims, 3 Drawing Sheets

COLLECTION AND PROCESSING CONTAINER CONFIGURED FOR REMOVABLE DISPOSITION WITHIN A REFUSE COLLECTION VEHICLE

BACKGROUND

The present disclosure is related to refuse collection and recycling, and more specifically to a removably replaceable container for collection of food product waste which may be configured for partial processing of the food product waste during transit.

Modern refuse collection vehicles (e.g., garbage trucks) serve to collect relatively small quantities of trash or recyclables (collectively referred to herein as refuse) from collections points, compress collected refuse to extend the efficiency of the collection route, then deliver the refuse to one or more of a transfer station, recycling center, etc. (generically referred to as a "processing location"). One form of typical refuse collection vehicle is referred to as a "front loader" or "front-end loader" (FEL), since collection containers are raised from the front end of the collection vehicle. For example, the collection vehicle may be provided with a pair of parallel forks and a lifting mechanism extending from the front of the vehicle. In service, the forks are aligned with channels on a collection bin (i.e., dumpster). The lifting mechanism and forks lift the bin overhead, then invert the bin to empty its contents into a hopper, often disposed immediately behind the driver's cab of the collection vehicle. A plunger (e.g., a hydraulic ram) then pushes the waste toward the back of the vehicle to compact it and make room for the next load. At the processing location the compacted waste may then be forced out of an openable gate at the rear of the vehicle for processing or further transfer.

Apart from manual separation of recyclables at the point of collection, no processing or separation of the collected waste is performed prior to handling at a processing location. Waste is simply collected and compacted, then delivered for subsequent processing.

For known refuse vehicles, the hopper and compaction mechanism are bolted or even welded to the chassis of the vehicle itself or form an integral part of the collection container carried by the vehicle. The hopper and compaction mechanism are generally not readily removable from the collection vehicle, and generally not interchangeable with similar or different functioning systems, other than for repair or replacement of these components.

In certain transfer dump truck designs a secondary container (i.e., an aggregate container or B box) is configured to be removably disposed within a primary container (i.e., the container fixedly attached to the truck itself). The secondary container is often transported on a trailer behind the truck. The secondary container is carried by the trailer on rails, permitting the secondary container to slide from the trailer into the empty primary container on the dump truck. In use, once the contents of the primary container are "dumped" by the lifting mechanism of the truck, the secondary container may be slid into the primary contain and its contents dumped by the lifting mechanism of the truck. These vehicles simply receive, transport and off-load material deposited into the primary and secondary containers. No processing of any deposited material is performed.

Primary food product waste recycling systems are being developed and improved. See for example co-pending U.S. patent application Ser. No. 13/835,081, titled "System for Processing Primary Food Product Waste into Secondary Food Product", incorporated herein by reference. These systems receive primary food product waste and convert it into secondary food product such as animal feed. Efficient operation of such recycling systems is enhanced by some pre-processing of the primary food product waste, a relatively continuous supply of primary food product waste, environmentally considerate transportation of the primary food product waste to the recycling system, prevention of introduction of contaminants into the primary food product waste during transport, and so on.

SUMMARY

Accordingly, the present disclosure is directed to aspects of a container for the working and transportation of food product waste addressing a number of the shortfalls of existing waste transport and containment. More specifically, disclosed is a container for the working and transportation of food product waste comprising: a shell configured for removable disposition within a refuse collection vehicle, the shell defining an interior region and having formed therein at least one material-input opening and at least one sealable material-output port; a cover, moveably secured to the shell and disposed such that the cover may be moved from a first position substantially covering said opening, and thereby substantially isolating the interior region from an environment around the shell, to a second position at least partially not covering said opening; at least one separation floor disposed in the interior region, the separation floor having openings formed therein to permit at least fluid to pass therethrough and to prevent solids of a selected size or greater from passing therethrough; a reservoir communicatively coupled to the interior region for removably collecting fluid passing through the at least one separation floor; and a working and transfer mechanism, disposed within the interior region, configured for working food product waste within the interior region, and transferring food product waste to the material-output port.

According to one aspect of the disclosure, the working and transfer mechanism comprises at least one rotatable screw auger, oriented parallel to a longitudinal axis of the container and coupling the interior region to the material-output port. A drive motor may be disposed on the container and coupled to the at least one rotatable screw auger to cause rotation thereof.

According to a further aspect of the disclosure, a mechanism is provided on the container for engaging with an opener on the refuse collection vehicle, configured such that the opener of the refuse collection vehicle may move the cover from the first position to the second position and back. The opener may form a component of a lifting and inverting mechanism of the refuse collection vehicle, configured such that the opener temporarily moves the cover from the first position to the second position in the process of lifting and inverting a collection bin for emptying contents thereof into the interior region, and otherwise maintains the cover in the first (sealed) position.

According to a still further aspect of the disclosure, a liquid storage reservoir and a separation floor coupled to the reservoir may be disposed within the container such that liquid constituent of food product waste within the interior region may be separated from solid constituent of the food product waste by the separation floor, the reservoir configured to receive and retain such liquid. The separation floor may comprise a surface having a screen or holes disposed therein, the screen or holes sized and positioned to permit liquid constituent to pass therethrough into the reservoir and to prevent solid constituent of a designated size or greater from passing therethrough.

Implementations of various of these aspects may also include facilities for disposing the container with an envelope of the refuse collection vehicle, such as shape and size of the container, location of openings and ports, and so on. Fittings may also be secured to the container for facilitating loading and unloading of the container into and out of the refuse collection vehicle.

The above is a brief summary of a number of unique aspects, features, and advantages of the present disclosure. The above summary is provided to introduce the context and certain concepts relevant to the full description that follows. However, this summary is not exhaustive. The above summary is not intended to be nor should it be read as an exclusive identification of aspects, features, or advantages of the claimed subject matter. Therefore, the above summary should not be read as imparting limitations to the claims nor in any other way determining the scope of said claims.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details.

Figure 1:
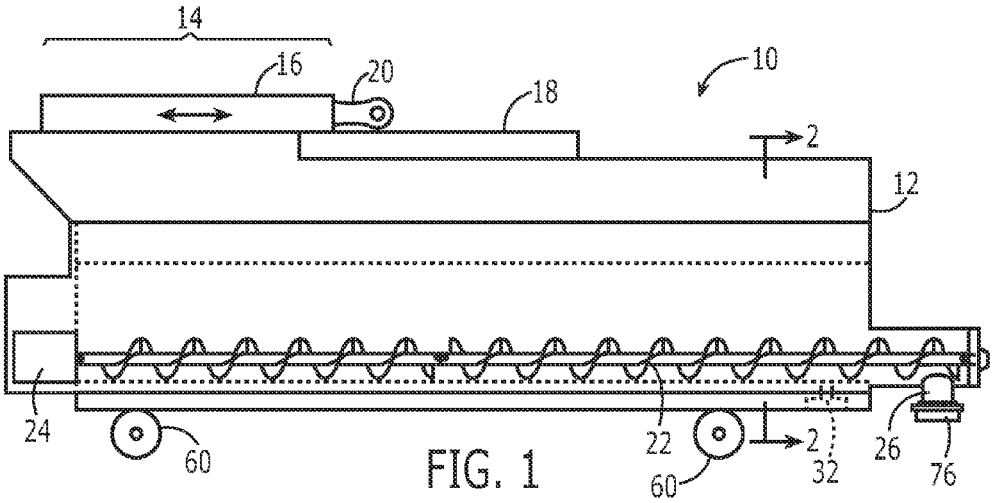
FIG. 1 is a side view of a collection and processing container configured for removable disposition within a refuse collection vehicle according to one embodiment of the present disclosure.
Figure 2:
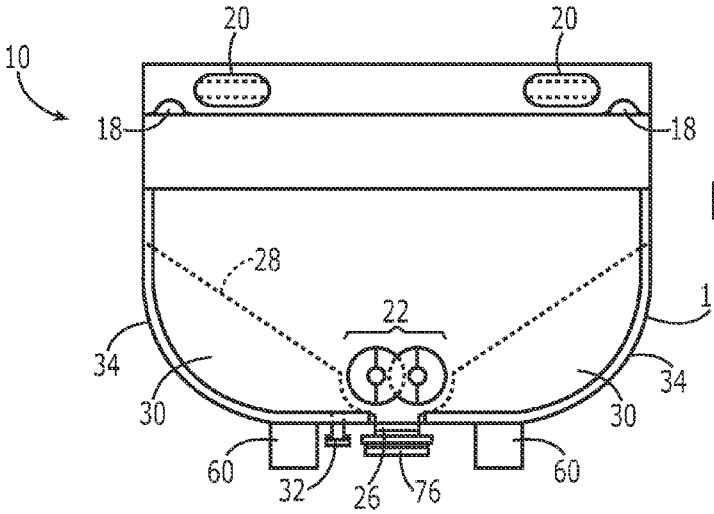
FIG. 2 is an end view of a collection and processing container configured for removable disposition within a refuse collection vehicle according to the embodiment illustrated in FIG. 1.

We refer first to FIGS. 1 and 2, which illustrate a side-view and an end-view of a collection and processing container 10, respectively, configured for removable disposition within a refuse collection vehicle according to one embodiment of the present disclosure. Container 10 comprises a shell 12, formed for example from steel or other high-strength, corrosion resistant material. As will be explained further below, container 10 is shaped and configured to fit within the envelope of a refuse collection vehicle, such as one having at least portions of its hopper and compactor removed. Container 10 has a first, or proximal, end at which is formed a material-input opening 14 for receiving product from, for example, a front loading refuse collection vehicle. The location of this opening corresponds to the chute into which refuse is deposited by the truck, for example immediately behind the driver cab, by way of lifting and inverting of a dumpster as otherwise known.

A cover 16 is provided for sealable containing of the material deposited into container 10 through opening 14. Cover 16 is provided with a sliding mechanism, such as runners 18, to provide surfaces of reduce friction, and hence reduced required power, to open and close cover 16. According to one embodiment, cover 16 may be in a first or closed position. Cover 16 may be moved to a second position which fully or partially opens opening 14 in conjunction with the lifting and inverting of a collection bin by the forks of the vehicle. Cover 16 remains closed (in the first position), and the contents of container 12 sealed from the environment thereby, except when the truck's lifting mechanism is positioned to dump contents from a collection bin into container 10. Engagement mechanisms 20 may operatively connect to elements of the vehicle to coordinate opening of cover 16 with operation of the truck's lifting mechanism. Sealing of container 12 effectively keeps primary food product waste separated from the general environment in order to keep odor to a minimum, minimize attraction of insect, rodents, and other vectors, and in order to minimize contamination of the primary food product waste during transport. Alternatively, cover 16 may remain open during the collection phase, and may be closed at some other phase, such as a transportation phase, or a staging phase prior to processing of the contents thereof. During any staging and subsequent transfer of food product waste from container 10 to a food product recycling system, cover 16 may remain closed so that the holding and delivery takes place separated from the general environment.

Container 12 may be provided with one or more screw augurs or other working and transfer mechanism 22 for working and transferring of material deposited therein. In embodiments in which working and transfer mechanism 22 comprise a rotating member (such as a screw auger or augers), a motor 24 may be provided to drive the mechanism. Alternatives to augers, such as hydraulic rams, expandable bladders, and other forms of working and transfer mechanism contemplated hereby may be driven by some other appropriate mechanism, not shown but contemplated herein. Working and transfer mechanism 22 may serve at least two functions. First, food product waste may be worked while the product is in transit from the pickup location to the staging or processing location. "Working" of the product in this context includes, but is not limited to, separating constituent elements of the product, reducing the physical size (e.g., chopping, crushing, milling, and/or filtering) of constituent elements of the product, and so on, and comprises more than merely compressing of the product. Second, food product waste may be transferred from within container 10 to a material-output port 26 configured to be connected to other elements of a processing system.

Figure 3:
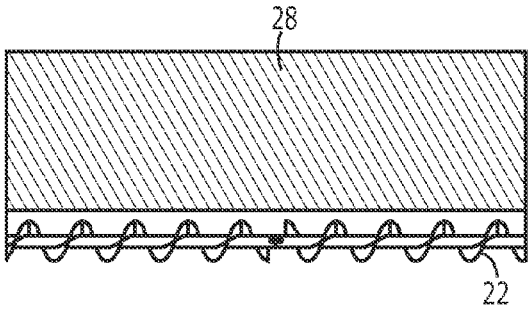
FIG. 3 is a top view of a separation floor as disposed within the interior region of a collection and processing container according to one embodiment of the present disclosure.

According to one embodiment of the present disclosure, container 10 is provided with at least one downward sloping interior separation floor 28, configured to converge proximate working and transfer mechanism 22. An example of separation floor 28 is illustrated in FIG. 3. Separation floor(s) 28 are formed to be or to include screens or openings, sized and configured such that liquid constituents of food product waste may preferentially be filtered out of the product waste within container 10. Gravity screening alone through separation floors 28 may separate liquid from the food product waste deposited into container 10. One or more of agitation of product waste within container 10 during transport, accumulated weight of the product waste within container 10, and/or working of the product waste by working and transfer mechanism 22 may further assist with extraction of liquid from the product waste. The liquid is accumulated within one or more liquid holding reservoirs 30 disposed between external walls 34 of container 10 and separation floors 28. An output port 32 is provided for draining the reservoir(s) 30, such as at a processing location.

Figure 4:
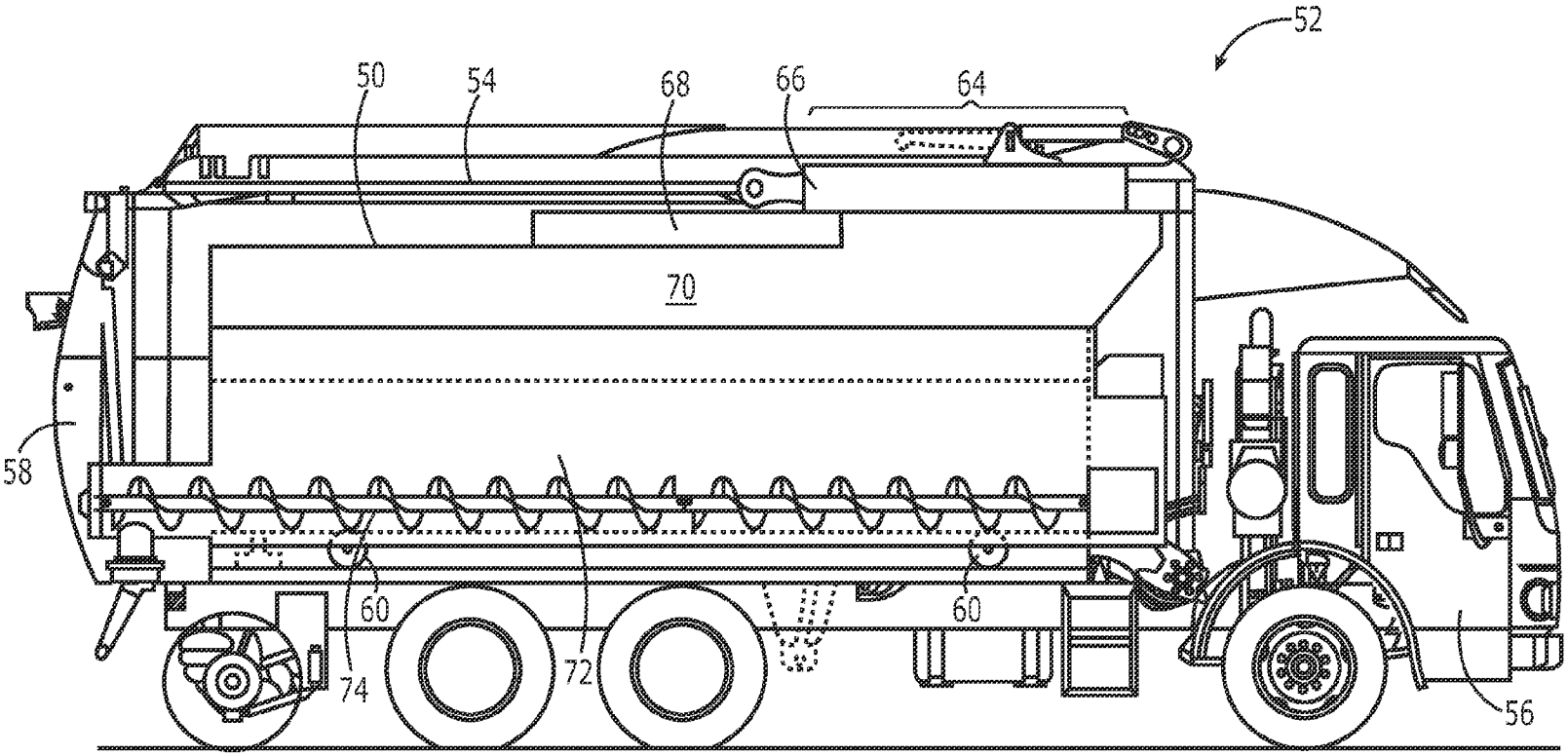
FIG. 4 is an illustration of a collection and processing container removably disposed within a refuse collection vehicle according to one embodiment of the present disclosure.

With reference to FIG. 4, one embodiment of a collection and processing container 50 is shown disposed within the envelope of a refuse collection vehicle 52. An "envelope" of vehicle 52 as used herein is intended to mean the space interior to a body or housing 54 (excluding cab 56) carried by the vehicle, as opposed for example to open space such as where no body or housing is present. Often this is a space in which waste is collected and in which a compactor is disposed for compacting the waste. In certain embodiments, at least portions of the compactor (and other internal equipment and attachments) may be removed from the body or housing in order to accommodate container 50, while in other embodiments container 50 is sized and shaped to accommodate items remaining within the envelope.

Refuse collection vehicle 52 includes an openable rear gate 58 that is typically used for removal of compacted waste. Collection and processing container 50 is of a shape and size, and otherwise configured to removably slide into the envelope of refuse collection vehicle 52 through open rear gate 58, although in certain embodiments gate 58 may not be present or be removed to accommodate container 50. With reference also to FIGS. 1 and 2, wheels (or skids) 60 may be provided to permit the sliding insertion of collection and processing container 50 within vehicle 52 such that resistance is minimized, and fittings such as ports 26 and 32 do not impeded insertion or removal of container 50 and are not damaged while container 50 is inserted or removed.

In one example of operation, vehicle 52 has disposed within its envelope container 50. Vehicle 52 may be a front-end loader (FEL) type collection vehicle. At various collection sites specific food product waste is collected in collection bins (i.e., dumpsters). Sources of food product waste may be restaurants, food production or processing facilities, public areas (e.g., with signage such that the public is alerted that the bin is for a specific waste type only), etc. Vehicle 52 lifts and inverts the bin for emptying as is standard for a front-end loader. Cover 66 over opening 64 in the top of container 50 slides open as the bin is lifted and positioned for dumping to allow product to be dumped from the collection bin into the interior 70 of container 50. Once within interior 70, liquid from the waste may be collected in reservoirs 72 located at the bottom and sides of container 50 for later recycling or disposal. Working and transfer mechanism 74 works the waste within interior 70, for example to further extract liquid, chop and compress the waste, and so on. The liquid extraction and waste processing within interior 70 may take place while vehicle 52 is in transit, for example to subsequent collection locations or to a staging or processing location. During any transit time, cover 64 may be closed such that the contents within interior 70 are effectively isolated from the general environment outside of container 50.

At certain times, such as during loading and transport of container 50, a cover 76 (or other sealing mechanism such as a gate, etc.) may be place over the opening of port 26 (illustrated in FIGS. 1 and 2). While in place, cover 76 prevents food product waste from exiting through port 26. In certain embodiments, the presence of cover 76, and hence the stopping of food product waste from exiting port 26, causes working and transfer mechanism 74 to perform primarily a working function. When removed, working and transfer mechanism 74 performs primarily a transfer function, transferring food product to a receptacle or facility external to container 50.

Once interior 70 is full, the last collection location has been serviced, or the food product waste in interior 70 is otherwise to be delivered to a selected staging and/or processing location, vehicle 52 proceeds to said staging and/or processing location. At the staging and/or processing location container 50 may be off-loaded from vehicle 52, and optionally an empty container (not shown) is loaded into vehicle 52 in place of container 50. Port 26 (FIGS. 1 and 2) may be connected to a corresponding receiving port of a food product waste recycling system such as disclosed in the aforementioned U.S. application Ser. No. 13/835,081. Food product waste may then be transferred in a sealed fashion from container 50 to the recycling system for additional processing, description of which is beyond the scope of the present disclosure.

Figure 5:
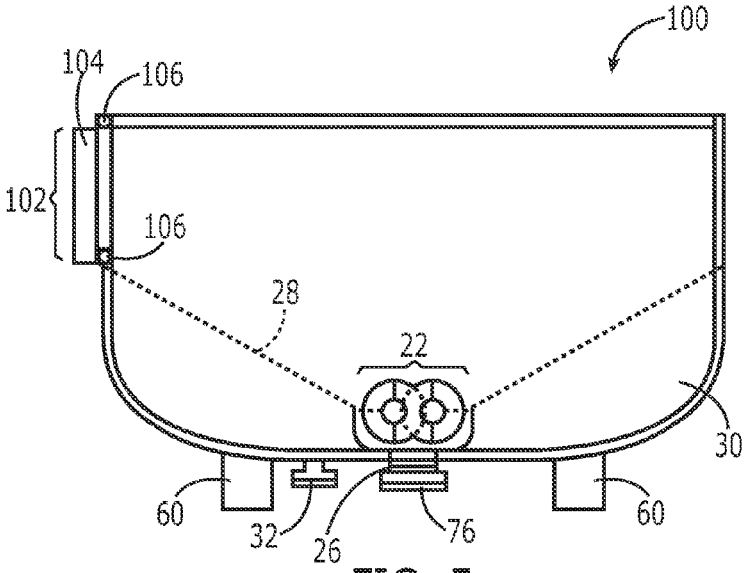
FIG. 5 is an end view of a collection and processing container configured for removable disposition within a refuse collection vehicle according to another embodiment of the present disclosure.
Figure 6:
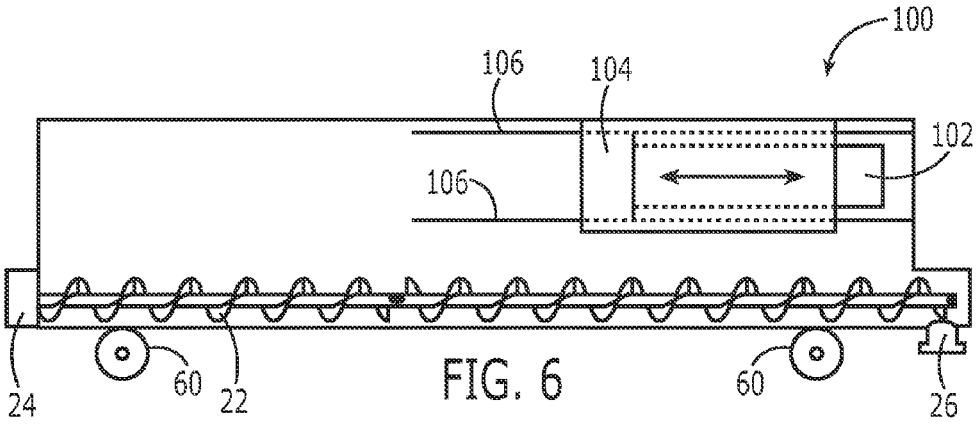
FIG. 6 is a side view of a collection and processing container configured for removable disposition within a refuse collection vehicle according to the embodiment illustrated in FIG. 5.

The descriptions above have assumed that the vehicle in use is a front-end loading collection vehicle, with the container having a sealable top opening. However, other arrangements are contemplated herein. For example, with reference to FIGS. 5 and 6, a side-loading container 100, with many of the aforementioned features and components, may form an alternate embodiment. In place of a top opening, container 100 comprises an opening 102 in one side thereof. A cover 104 may be provided, which travels on slides 106, for example under control of a side-load mechanism of a refuse transport vehicle. Some or all of the elements disclosed above may be present, and may operate in a fashion similar to that disclosed above.

Similarly, while one opening is disclosed in the embodiments above, containers with two or more openings are within the scope of the present disclosure. Those openings may be on the same or different surfaces of the container, depending on the particular implementation of the present disclosure. Each of the multiple openings has a corresponding cover to maintain isolation of the contents of the container from the general environment. Opening and closing of the covers may be coordinated or independent, again depending on the particular implementation.

Furthermore, it has been assumed above that the cover for the food product waste container operates under automatic control of a loading mechanism of a transport vehicle. However, operation of the cover in any of the embodiments disclosed herein may be manual or semi-automatic in the sense that a worker may engage an opening mechanism and a bin emptying mechanism separately, with or without powered assistance.

It will be understood that the description and illustration of the location of elements of the various embodiments above is by way of example only, and that variations in the number, position, orientation, size, and so on of such elements and the container itself are within the scope of the present disclosure. Further, while various elements and features of a collection and processing container have been disclosed, the addition of further elements and features is contemplated herein. For example, additional mechanisms for assisting with the separation of liquid from food product waste by separation floors 28 (FIGS. 1 and 2) may be provided within the container, mechanisms to assist with loading and unloading of the container from a refuse collection vehicle may be provided on or associated with the container, access ports, working and transfer mechanism release means, and so on may be provided depending upon the specific implementation of the present disclosure.

Therefore, while examples and variations have been presented in the foregoing description, it should be understood that a vast number of variations exist, and the above examples are merely representative, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described examples may be made without departing from the spirit and scope of the disclosure defined by the claims thereto.

What is claimed is:

1. A container for the working and transportation of food product waste, comprising:

a shell configured for removable disposition within a refuse collection vehicle, said shell defining an interior region and having formed therein at least one material-input opening and at least one sealable material-output port;

a cover, moveably secured to said shell and disposed such that said cover may be moved from a first position substantially covering said opening, and thereby substantially isolating said interior region from an environment around said shell, to a second position at least partially not covering said opening;

at least one separation floor disposed in said interior region, said separation floor having openings formed therein to permit at least fluid to pass therethrough and to prevent solids of a selected size or greater from passing therethrough;

a reservoir communicatively coupled to said interior region for removably collecting fluid passing through said at least one separation floor;

a working and transfer mechanism, disposed within said interior region, configured for working food product waste within said interior region, and transferring food product waste to said material-output port; and a mechanism for engaging with an opener on said refuse collection vehicle, configured such that said opener of said refuse collection vehicle moves said cover from said first position to said second position and from said second position to said first position.

2. The container of claim 1, wherein said working and transfer mechanism comprises at least one rotatable screw auger, oriented parallel to a longitudinal axis of said container and coupling said interior region to said material-output port.

3. The container of claim 2, further comprising a drive motor disposed on said container and coupled to said at least one rotatable screw auger to cause rotation thereof.

4. The container of claim 1, wherein said opener forms a component of a lifting and inverting mechanism of said refuse collection vehicle, configured such that said opener temporarily moves said cover from said first position to said second position in the process of lifting and inverting a collection bin for emptying contents thereof into said interior region, and otherwise maintains said cover in said first position.

5. The container of claim 4, wherein said at least one material-input opening is disposed on an upper surface of said container when said container is disposed within said refuse collection vehicle, such that when said refuse collection vehicle is a front-end loading vehicle said opening is aligned with the position at which said lifting and inverting mechanism positions a lifted and inverted collection bin, and further aligned such that contents of said lifted and inverted collection bin will fall into said interior region.

6. The container of claim 1, further comprising a plurality of runners supporting said cover, said runners providing surfaces for relatively low-friction sliding of said cover between said first and second positions thereof.

7. The container of claim 1, further comprising a liquid storage reservoir and a separation floor coupled to said reservoir such that liquid constituent of food product waste within said interior region may be separated from solid constituent of said food product waste by said separation floor, said reservoir configured to receive and retain such liquid.

8. The container of claim 7, wherein said reservoir is disposed within said interior region.

9. The container of claim 8, wherein said separation floor comprises a surface having a screen or holes disposed therein, said screen or holes sized and positioned to permit liquid constituent to pass therethrough into said reservoir and to prevent solid constituent of a designated size or greater from passing therethrough.

10. The container of claim 9, further comprising a liquid output port communicatively coupled to said reservoir facilitating output of liquid constituent from said reservoir.

11. The container of claim 1, further comprising fittings secured thereto for facilitating loading and unloading of said container into and out of said refuse collection vehicle.

12. The container of claim 1, wherein said material-input opening is a first material-input opening, and further comprising a second material-input opening formed in said shell, and still further comprising a second cover moveably secured to said shell and disposed such that said cover may be moved from a first position substantially covering said second opening, and thereby substantially isolating said interior region from an environment around said shell, to a second position at least partially not covering said second opening.

13. The container of claim 12, wherein said first material-input opening is formed on a first side of said shell, and wherein second material-input opening is formed on a second side of said shell different than said first side.

14. A container for the working and transportation of food product waste, comprising:

a shell configured for removable disposition within a refuse collection vehicle, said shell defining an interior region and having formed therein at least one material-input opening and at least one sealable material-output port;

a cover, moveably secured to said shell and disposed such that said cover may be moved from a first position substantially covering said opening, and thereby substantially isolating said interior region from an environment around said shell, to a second position at least partially not covering said opening;

a mechanism for engaging with a lifting and inverting mechanism of said refuse collection vehicle, configured such that said lifting and inverting mechanism temporarily moves said cover from said first position to said second position in the process of lifting and inverting a collection bin for emptying contents thereof into said interior region, and otherwise maintains said cover in said first position;

at least one separation floor disposed in said interior region, said separation floor having openings formed therein to permit at least fluid to pass therethrough and to prevent solids of a selected size or greater from passing therethrough;

a reservoir communicatively coupled to said interior region for removably collecting fluid passing through said at least one separation floor; and a working and transfer mechanism, disposed within said interior region, configured for working food product waste within said interior region, and transferring food product waste to said material-output port.

15. The container of claim 14, wherein said working and transfer mechanism comprises at least one rotatable screw auger, oriented parallel to a longitudinal axis of said container and coupling said interior region to said material-output port.

16. The container of claim 15, further comprising a drive motor disposed on said container and coupled to said at least one rotatable screw auger to cause rotation thereof.

17. The container of claim 14, further comprising a separation floor defining a liquid storage reservoir within said interior region, said separation floor comprising a surface having a screen or holes disposed therein, said screen or holes sized and positioned to permit liquid constituent to pass therethrough into said reservoir and to prevent solid constituent of a designated size or greater from passing therethrough, such that liquid constituent of food product waste within said interior region may be separated from solid constituent of said food product waste by said separation floor, said reservoir configured to receive and retain such liquid.

18. The container of claim 14, further comprising fittings secured thereto for facilitating loading and unloading of said container into and out of said refuse collection vehicle.

19. A container for the working and transportation of food product waste, comprising:

a shell configured for removable disposition within a refuse collection vehicle, said shell defining an interior region and having formed therein at least one material-input opening and at least one sealable material-output port;

a cover, moveably secured to said shell and disposed such that said cover may be moved from a first position substantially covering said opening, and thereby substantially isolating said interior region from an environment around said shell, to a second position at least partially not covering said opening;

a mechanism for engaging with a lifting and inverting mechanism of said refuse collection vehicle, configured such that said lifting and inverting mechanism temporarily moves said cover from said first position to said second position in the process of lifting and inverting a collection bin for emptying contents thereof into said interior region, and otherwise maintains said cover in said first position;

at least one separation floor disposed in said interior region, said separation floor having openings formed therein to permit at least fluid to pass therethrough and to prevent solids of a selected size or greater from passing therethrough;

a reservoir communicatively coupled to said interior region for removably collecting fluid passing through said at least one separation floor;

a working and transfer mechanism comprising at least one rotatable screw auger, oriented parallel to a longitudinal axis of said container and coupling said interior region to said material-output port, disposed within said interior region, configured for working food product waste within said interior region, and transferring food product waste to said material-output port; and a drive motor disposed on said shell and coupled to said at least one rotatable screw auger to cause rotation thereof.

* * * * *